US009243632B2

(12) United States Patent
Saga

(10) Patent No.: US 9,243,632 B2
(45) Date of Patent: Jan. 26, 2016

(54) VARIABLE DISPLACEMENT OIL PUMP

(75) Inventor: Koji Saga, Ebina (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 590 days.

(21) Appl. No.: 13/617,391

(22) Filed: Sep. 14, 2012

(65) Prior Publication Data

US 2013/0164162 A1 Jun. 27, 2013

(30) Foreign Application Priority Data

Dec. 21, 2011 (JP) ..... 2011-279096

(51) Int. Cl.
*F04C 14/26* (2006.01)
*F04C 2/344* (2006.01)
*F04C 14/22* (2006.01)

(52) U.S. Cl.
CPC ..... *F04C 2/344* (2013.01); *F04C 14/226* (2013.01)

(58) Field of Classification Search
CPC ..... F04C 2/38; F04C 2/40; F04C 2/44; F04C 14/18; F04C 14/22; F04C 14/223; F04C 14/226
See application file for complete search history.

(56) References Cited

U.S. PATENT DOCUMENTS 7,794,217 B2 * 9/2010 Williamson et al. ..... 418/26
2007/0224067 A1 * 9/2007 Arnold et al. ..... 418/26
2009/0269233 A1 * 10/2009 Fujita et al. ..... 418/26

OTHER PUBLICATIONS

Co-pending U.S. Appl. No. 13/615,709, filed Sep. 14, 2012.

* cited by examiner

*Primary Examiner* — Nathan J Newhouse
*Assistant Examiner* — Christopher Bobish
(74) *Attorney, Agent, or Firm* — Crowell & Moring LLP

(57) ABSTRACT

An oil pump includes first and second control chambers, a biasing mechanism, and a changeover mechanism. The changeover mechanism connects the first control chamber with a drain portion when a valving element is in a first position, introduces a discharge pressure into the first and second control chambers when the valving element reaches a second position, and drains oil of the second control chamber to the drain portion and introduces the discharge pressure into the first control chamber when the valving element reaches a third position. The changeover mechanism changes from the first position to the second position, when the discharge pressure becomes higher than a pressure level at which the cam ring can move against a set load of the biasing mechanism, and is lower than a pressure level at which a biasing force of the biasing mechanism is increased in a stepwise manner.

16 Claims, 7 Drawing Sheets

VARIABLE DISPLACEMENT OIL PUMP

BACKGROUND OF THE INVENTION

The present invention relates to a variable displacement oil pump adapted to supply working fluid as a hydraulic pressure source.

U.S. Pat. No. 7,794,217 discloses a previously-proposed variable displacement oil pump which is applied to an internal combustion engine for an automobile.

The variable displacement pump disclosed in this patent is a vane-type variable-displacement oil pump. In this technique, an eccentricity amount of a cam ring is controlled in two stages according to rotational speed of the engine, on the basis of spring force of a spring and biasing force of a discharge pressure introduced into two control oil chambers which are separately formed between a pump housing and the cam ring. The spring is provided to bias the cam ring in a direction (hereinafter referred to as "eccentric direction") that increases the eccentricity amount of the cam ring relative to a rotation center of a rotor. The discharge pressure introduced into the two control oil chambers acts to bias the cam ring in a concentric direction (i.e., opposite to the eccentric direction) against the spring force of the spring. Accordingly, the oil pump can supply oil to a plurality of devices which desire discharge-pressure values different from each other.

Specifically, when the engine rotational speed rises, the discharge pressure is introduced into one of the two control oil chambers. Then, when the discharge pressure reaches a first predetermined oil-pressure value which is a first equilibrium pressure, the cam ring moves somewhat in the concentric direction against the spring force of the spring. Then, if the engine rotational speed further rises, the discharge pressure is introduced also into another of the two control oil chambers in addition to the one of the two control oil chambers. Then, when the discharge pressure reaches a second predetermined oil-pressure value which is a second equilibrium pressure, the cam ring moves further in the concentric direction against the spring force of the spring.

SUMMARY OF THE INVENTION

However, in the case of the previously-proposed oil pump, it becomes hard for the cam ring to swing with the increase of the discharge pressure since the spring is used to restrict the operation of the cam ring. Hence, the discharge pressure rises greatly with the increase of the engine rotational speed even if trying to maintain the discharge pressure at the first predetermined oil-pressure value or the second predetermined oil-pressure value. Thus, there is a problem that a desired discharge-pressure characteristic is not sufficiently ensured.

It is therefore an object of the present invention to provide a variable displacement oil pump devised to maintain the desired discharge-pressure level even if the engine rotational speed increases.

According to one aspect of the present invention, there is provided a variable displacement oil pump comprising: a rotor configured to be rotationally driven; a plurality of vanes movable out from and into an outer circumferential portion of the rotor; a cam ring separately forming a plurality of working-oil rooms by receiving the rotor and the plurality of vanes in an inner circumferential space of the cam ring, wherein the cam ring is configured to move to vary an eccentricity between a rotation center of the rotor and a center of an inner circumferential surface of the cam ring and thereby to vary a variation rate of volume of each of the plurality of working-oil rooms which is produced when the rotor rotates; a lateral wall provided on at least one of lateral portions of the cam ring, wherein the lateral wall includes a suction portion open to the working-oil room whose volume is increasing when the rotor is rotating under a state where the cam ring is eccentric, and a discharge portion open to the working-oil room whose volume is decreasing when the rotor is rotating under the state where the cam ring is eccentric; a first control oil chamber configured to apply a first biasing force to the cam ring in a direction that reduces the eccentricity between the rotation center of the rotor and the center of the inner circumferential surface of the cam ring, by oil discharged and introduced from the discharge portion into the first control oil chamber; a second control oil chamber configured to apply a second biasing force to the cam ring in a direction that enlarges the eccentricity between the rotation center of the rotor and the center of the inner circumferential surface of the cam ring, by oil discharged and introduced from the discharge portion into the second control oil chamber, wherein the second biasing force is smaller than the first biasing force;

a biasing mechanism configured to apply a third biasing force to the cam ring in the direction that enlarges the eccentricity between the rotation center of the rotor and the center of the inner circumferential surface of the cam ring under a state where the biasing mechanism is given a set load, wherein the biasing mechanism is configured to increase the third biasing force discontinuously in a stepwise manner when the eccentricity between the rotation center of the rotor and the center of the inner circumferential surface of the cam ring becomes lower than or equal to a predetermined amount; and a changeover mechanism including a valving element receiving a fourth biasing force in a direction toward a first position of the valving element and configured to move against the fourth biasing force by a discharge pressure discharged from the discharge portion, configured to connect the first control oil chamber with a drain portion when the valving element is in the first position, configured to introduce the discharge pressure into the first control oil chamber and the second control oil chamber when the valving element moves and reaches a second position thereof against the fourth biasing force, and configured to drain a part of oil of the second control oil chamber to the drain portion and to continue to introduce the discharge pressure into the first control oil chamber when the valving element moves from the second position and reaches a third position thereof against the fourth biasing force, wherein the changeover mechanism changes from the first position of the valving element to the second position of the valving element, when the discharge pressure becomes higher than or equal to a pressure level at which the cam ring can move against the set load of the biasing mechanism, and is lower than or equal to a pressure level at which the third biasing force of the biasing mechanism is increased in the stepwise manner.

According to one aspect of the present invention, there is provided a variable displacement oil pump comprising: pump constituting members configured to be rotationally driven such that oil introduced from a suction portion is discharged from a discharge portion, and configured to vary volumes of a plurality of working-oil rooms with a rotation thereof; a varying mechanism configured to vary a volume-variation rate of each of the plurality of working-oil rooms by moving a movable member; a biasing mechanism configured to bias the movable member in a direction that increases the volume-variation rate of the working-oil room under a state where the biasing mechanism is given a set load; a first control oil chamber configured to apply force to the movable member in a direction against the biasing direction of the biasing mechanism, by a discharge pressure introduced from the discharge portion into the first control oil chamber; a second control oil chamber configured to apply force to the movable member in the biasing direction of the biasing mechanism, by the discharge pressure introduced from the discharge portion into the second control oil chamber; a changeover mechanism configured to change over among a first position of a valving element in which at least the first control oil chamber communicates with a drain portion, a second position of the valving element in which the discharge pressure is introduced into the first control oil chamber and the second control oil chamber, and a third position of the valving element in which the discharge pressure is introduced into the first control oil chamber and a part of oil within the second control oil chamber is drained to the drain portion, in accordance with an operating state of the pump constituting members; and a restricting section configured to restrict the movement of the movable member when the changeover mechanism is in a position except the first position and the third position, wherein the changeover mechanism retains the valving element in the first position when the discharge pressure is lower than a pressure level by which the restricting section suppresses the movement of the movable member.

The other objects and features of this invention will become understood from the following description with reference to the accompanying drawings.

DETAILED DESCRIPTION OF THE INVENTION

Figure 1:
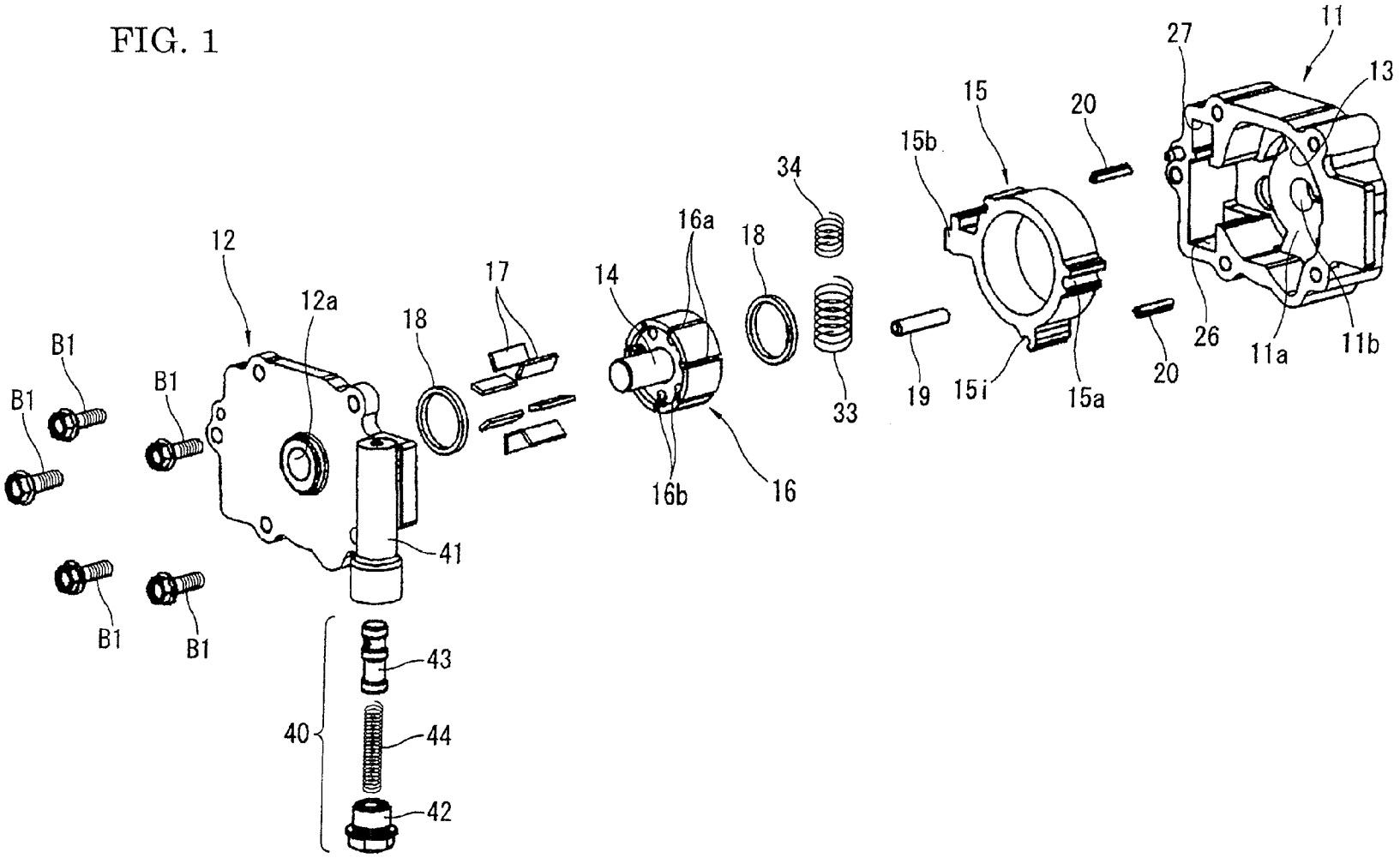
FIG. 1 is an exploded oblique perspective view showing a structure of a variable displacement pump in a first embodiment according to the present invention.
Figure 2:
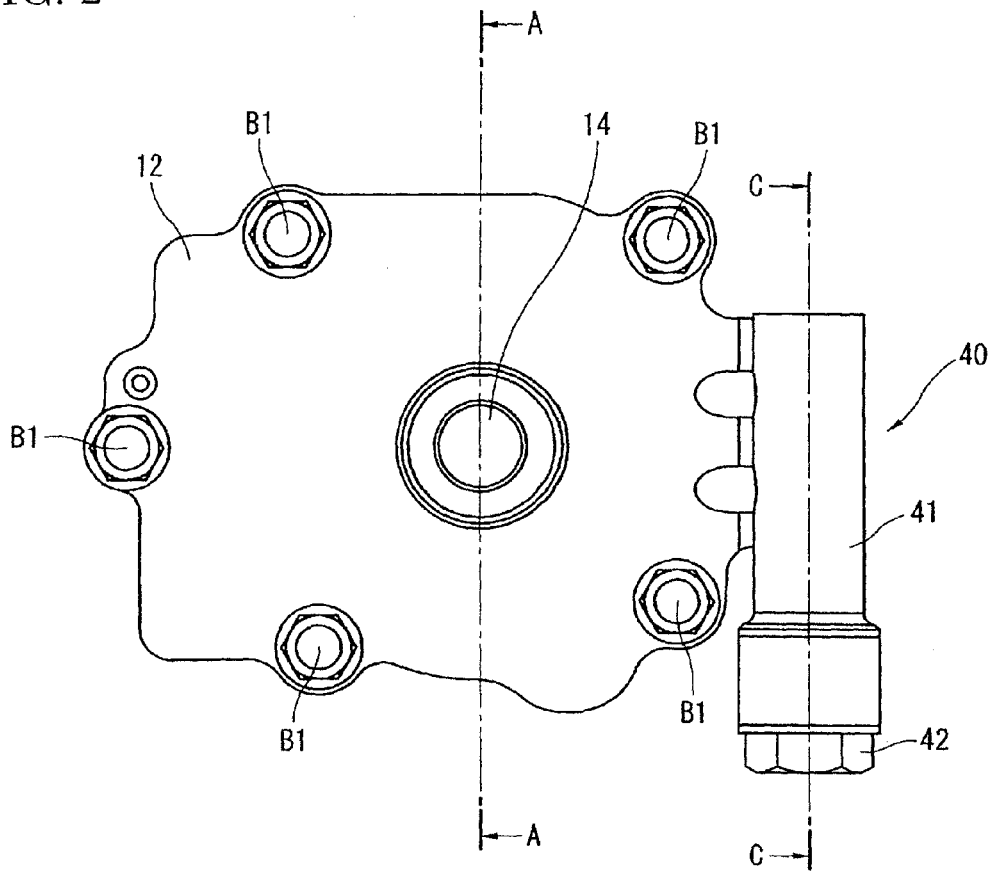
FIG. 2 is a front view of the variable displacement pump shown in FIG. 1.

Reference will hereinafter be made to the drawings in order to facilitate a better understanding of the present invention. Respective embodiments of variable displacement oil pump according to the present invention will be explained below in detail, referring to the drawings. The following respective embodiments will give examples in a case that the variable displacement oil pump is used as an oil pump which supplies lubricant to sliding portions of an internal combustion engine for a vehicle (automobile) and/or a valve-timing control device for controlling opening-and-closing timings of a valve of the internal combustion engine.

FIGS. 1 to 9 show an oil pump in a first embodiment according to the present invention. This oil pump 10 is provided to a frontend portion of cylinder block or a balancer device of the internal combustion engine (not shown). As shown in FIGS. 1 to 4, the oil pump 10 includes a pump housing, a drive shaft 14, a cam ring 15, pump constituting members, and a changeover control valve 40. The pump housing includes a pump body 11 and a cover member 12. The pump body 11 is formed substantially in a U shape in cross section taken by a plane parallel to an axial direction of the oil pump. That is, axially one end side of the pump body 11 is open such that a pump accommodation chamber 13 is formed inside the pump body 11. The cover member 12 covers or encloses the axially one end opening of the pump body 11. The drive shaft 14 is rotatably supported by the pump housing, and passes through an approximately central portion of the pump accommodation chamber 13. The drive shaft 14 is driven in rotation by a crankshaft, a balancer shaft or the like (not shown). The cam ring 15 is a movable member which is received to be able to move (swing) in the pump accommodation chamber 13. The pump constituting members are received radially inside the cam ring 15. The pump constituting members are driven in rotation by the drive shaft 14 in a clockwise direction of FIG. 4, and thereby increase or decrease respective volumes of pump rooms PR which are a plurality of working-oil chambers formed between the cam ring 15 and the pump constituting members. Thus, the pump constituting members perform a pumping action. The changeover control valve 40 is attached to (the cover member 12 of) the pump housing. This changeover control valve 40 is a change-over mechanism for a swing control of the cam ring 15. Specifically, the changeover control valve 40 switches between an introduction of discharge pressure into after-mentioned control oil chamber 31 and 32 and a drain of discharge pressure from the control oil chambers 31 and 32.

The pump constituting members include a rotor 16, vanes 17 and a pair of ring members 18. The rotor 16 is rotatably accommodated on an inner circumferential side of the cam ring 15. A central portion of the rotor 16 is combined with an outer circumference of the drive shaft 14. A plurality of slits 16*a* are formed by radially cutting (notching) an outer circumferential portion of the rotor 16. The vanes 17 are received respectively by the plurality of slits 16*a* to be able to rise and fall relative to an outer circumferential surface of the rotor 16. That is, each of the vanes 17 is movable out from and into the outer circumferential portion of the rotor 16. Each of the pair of ring members 18 is formed to have a diameter smaller than an outer diameter of the rotor 16. The pair of ring members 18 are disposed respectively on both axially side portions of an inner circumferential side of the rotor 16.

Figure 4:
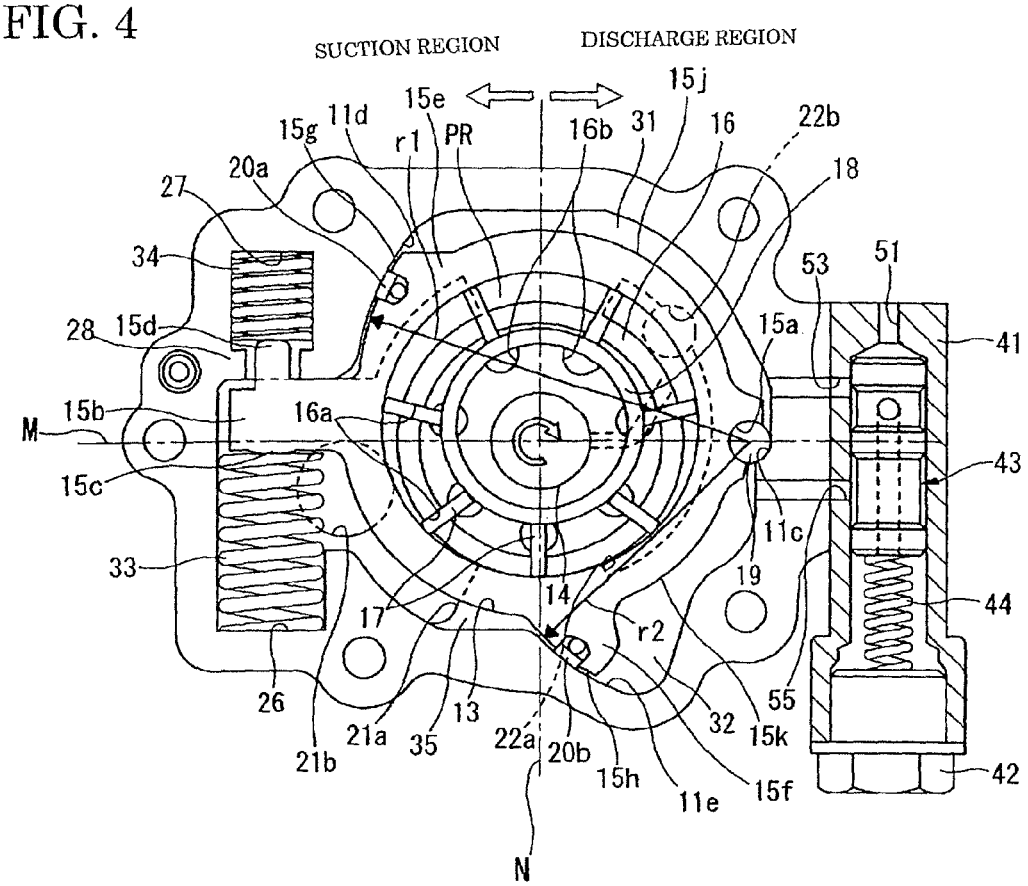
FIG. 4 is a cross-sectional view of FIG. 3, taken along a line B-B of FIG. 3 (as viewed in a direction of arrows B and B).

The pump body 11 is integrally formed of aluminum ally, and includes an end wall 11*a* constituting axially one end wall (lateral wall) of the pump accommodation chamber 13. The end wall 11*a* is formed with a bearing hole (shaft-receiving hole) 11*b* passing through a substantially center of the end wall 11*a*. The bearing hole 11*b* rotatably supports one end portion of the drive shaft 14. Moreover, a supporting groove 11*c* is formed at a predetermined portion of an inner circumferential wall of the pump accommodation chamber 13. The supporting groove 11*c* is formed so as to cut (notch) the inner circumferential wall of the pump accommodation chamber 13, and thereby formed in a substantially semicircular shape in cross section taken by a plane perpendicular to the axial direction. The supporting groove 11*c* swingably supports the cam ring 15 through a rod-shaped pivot pin 19. The inner circumferential wall of the pump accommodation chamber 13 includes a sealing slide-contact surface 11*d* with which a sealing member 20*a* provided in an outer circumferential portion of the cam ring 15 slides in contact. The sealing slide-contact surface 11*d* and the sealing member 20*a* are located in an upper half side of FIG. 4 (i.e., in the side of an after-mentioned second spring 34) with respect to an imaginary line M connecting a center of the bearing hole 11*b* with a center of the supporting groove 11*c*. (Hereinafter, this imaginary line M will be referred to as "cam-ring reference line") As shown in FIG. 4, the sealing slide-contact surface 11*d* is formed in a circular-arc shape in cross section which has a predetermined radius R1 regarding its center as the center of the supporting groove 11*c*. That is, the sealing slide-contact surface 11*d* is shaped like an inner surface of a cylinder, and has a circumferential length enough for the sealing member 20*a* to slide in contact with the sealing slide-contact surface 11*d* constantly over a swing range in which the cam ring 15 swings to have eccentricity. In the same manner, the inner circumferential wall of the pump accommodation chamber 13 includes a sealing slide-contact surface 11*e* with which a sealing member 20*b* provided in the outer circumferential portion of the cam ring 15 slides in contact. The sealing slide-contact surface 11*e* and the sealing member 20*b* are located in a lower half side of FIG. 4 (i.e., in the side of an after-mentioned first spring 33) with respect to the cam-ring reference line M. As shown in FIG. 4, the sealing slide-contact surface 11*e* is formed in a circular-arc shape in cross section which has a predetermined radius R2 regarding its center as the center of the supporting groove 11*c*. That is, the sealing slide-contact surface 11*e* is shaped like an inner surface of a cylinder, and has a circumferential length enough for the sealing member 20*b* to slide in contact with the sealing slide-contact surface 11*e* constantly over the swing range in which the cam ring 15 swings to have eccentricity. By such a structure, when the cam ring 15 swings to have eccentricity, the cam ring 15 is slid and guided along both the sealing slide-contact surfaces 11*d* and 11*e*, so that a smooth movement (eccentric swing) of the cam ring 15 can be attained.

Figure 5:
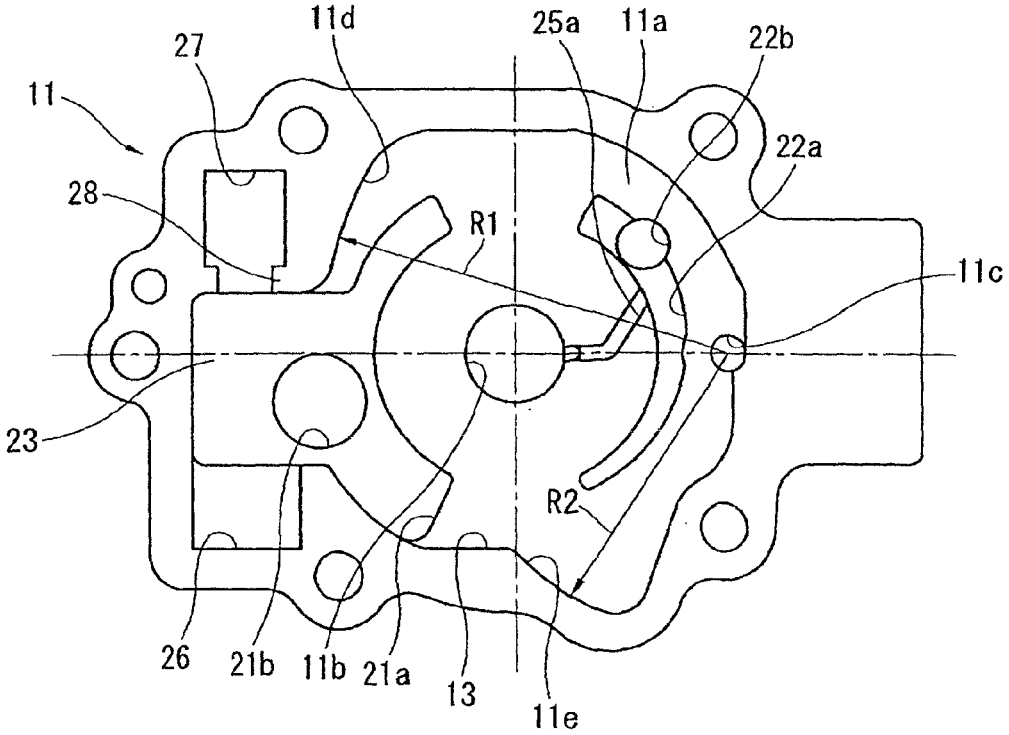
FIG. 5 is a stand-alone view of a pump body shown in FIG. 3, as viewed from a matching-surface side with a cover member.

As shown in FIGS. 4 and 5, in an inside surface of the end wall 11*a* of the pump body 11, a suction port 21*a* and a discharge port 22*a* are formed as recesses so as to face each other through the bearing hole 11*b*. That is, the suction port 21*a* and the discharge port 22*a* are located in an outer periphery of the bearing hole 11*b*, and the bearing hole 11*b* is located between the suction port 21*a* and the discharge port 22*a* in a plane perpendicular to the axial direction. The suction port 21*a* is formed by cutting (notching) the inside surface of the end wall 11*a* in a substantially arc shape, and is open to a region (hereinafter, referred to as "suction region") in which the volume of each pump room PR becomes larger with the pumping action of the pump constituting members. The discharge port 22*a* is formed by cutting (notching) the inside surface of the end wall 11*a* in a substantially arc shape, and is open to a region (hereinafter, referred to as "discharge region") in which the volume of each pump room PR becomes smaller with the pumping action of the pump constituting members.

The suction port 21*a* is formed integrally with a feeding portion 23. This feeding portion 23 bulges out from a circumferentially middle portion of the suction port 21*a* toward an after-mentioned first spring receiving chamber 26. An inlet 21*b* is formed near a boundary between the feeding portion 23 and the suction port 21*a*. The inlet 21*b* passes from the boundary through the end wall 11*a* of the pump body 11 to an external of the pump housing. By such a structure, lubrication oil retained in an oil pan (not shown) of the internal combustion engine is sucked through the inlet 21*b* and the suction port 21*a* to the pump rooms PR located in the suction region, by means of negative pressure caused by the pumping action of the pump constituting members. A low-pressure chamber 35 is formed on an outer circumferential surface of the cam ring 15 overlapping with the suction region. The suction port 21*a* cooperates with the feeding portion 23 to communicate with the low-pressure chamber 35. Thereby, low-pressure working oil (i.e., oil having a suction pressure) is introduced also into the low-pressure chamber 35.

An outlet 22*b* is formed at an upstream end portion of the discharge port 22*a*, and communicates with the discharge port 22*a*. The outlet 22*b* passes through the end wall 11*a* of the pump body 11 to an external of the pump housing. By such a structure, working oil pressurized and discharged into the discharge port 22*a* by the pumping action of the pump constituting members is supplied from the outlet 22*b* through a main oil gallery (not shown) provided in the cylinder block to sliding portions of the engine, the valve-timing control device and the like (not shown).

A communication groove 25*a* is formed in the inside surface of the end wall 11*a* by notching or cutting the inside surface of the end wall 11*a*. The communication groove 25*a* connects the discharge port 22*a* with the bearing hole 11*b* to flow oil therebetween. Working oil is supplied through this communication groove 25*a* to the bearing hole 11*b*. Thereby, working oil is supplied also to axially lateral portions of the rotor 16 and the respective vanes 17, so that a favorable lubrication of respective sliding parts thereof is ensured. It is noted that the communication groove 25*a* is formed not to extend in the rising and falling directions of each vane 17, so that each vane 17 is inhibited from dropping into the communication groove 25*a* when the vane 17 radially rises or falls relative to the rotor 16.

Figure 3:
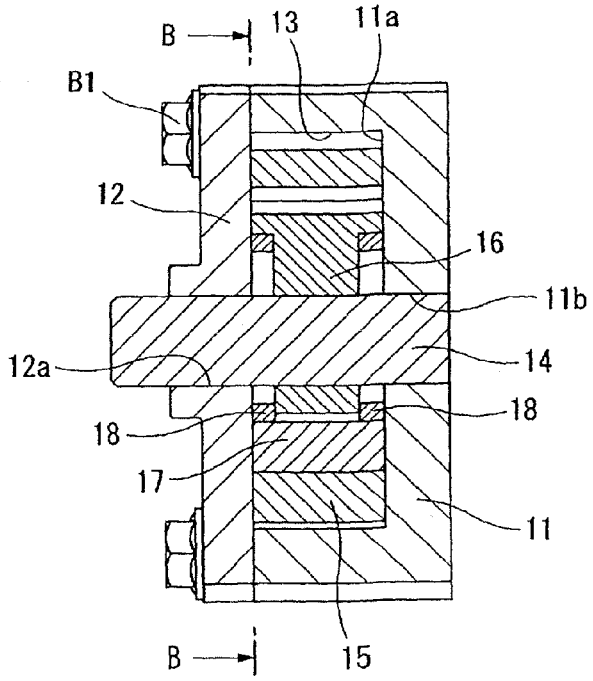
FIG. 3 is a cross-sectional view of FIG. 2, taken along a line A-A of FIG. 2 (as viewed in a direction of arrows A and A).
Figure 6:
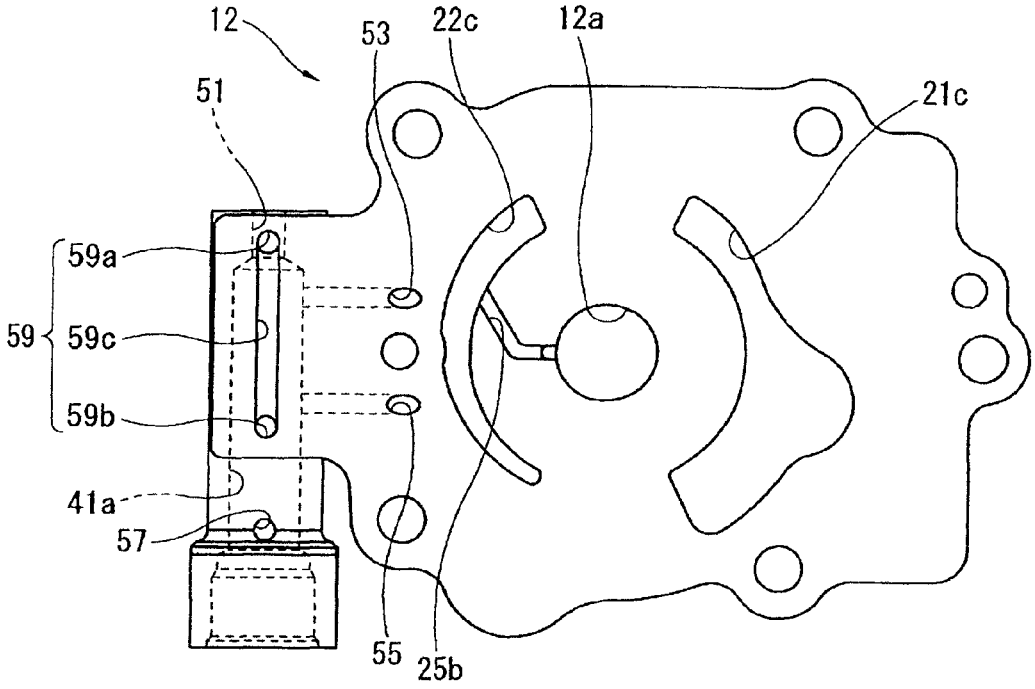
FIG. 6 is a stand-alone view of the cover member shown in FIG. 3, as viewed from a matching-surface side with the pump body.

As shown in FIGS. 3 and 6, the cover member 12 is formed substantially in a plate shape. The cover member 12 is attached to an end surface of the opening of the pump body 11 by means of a plurality of bolts B1. The cover member 12 is formed with a bearing hole (shaft-receiving hole) 12*a* which rotatably supports another end side of the drive shaft 14. The bearing hole 12*a* passing through a portion of the cover member 12 which faces (i.e., axially corresponds to) the bearing hole 11*b* of the pump body 11. A suction port 21*c*, a discharge port 22*c* and a communication groove 25*b* are formed in an inside surface of the cover member 12, in the same manner as those of the pump body 11. The suction port 21*c*, the discharge port 22*c* and the communication groove 25*b* respectively face (i.e., axially correspond to) the suction port 21*a*, the discharge port 22*a* and the communication groove 25*a* of the pump body 11.

As shown in FIG. 3, the drive shaft 14 passes through the end wall 11*a* of the pump body 11 to an external of the pump housing, so that an axially one end portion of the drive shaft 14 is linked to the crankshaft (not shown) or the like. By a rotational force transmitted from the crankshaft or the like, the drive shaft 14 rotates the rotor 16 in the clockwise direction of FIG. 4. As shown in FIG. 4, an imaginary line N passing through the center of the drive shaft 14 and extending perpendicular to the cam-ring reference line M defines a boundary between the suction region and the discharge region. (Hereinafter, this imaginary line N will be referred to as "cam-ring eccentric-direction line")

As shown in FIGS. 1 and 4, the rotor 16 is formed with the plurality of slits 16*a* each extending from a center side of the rotor 16 to a radially outer side of the rotor 16. Also, the rotor 16 is formed with a plurality of backpressure chambers 16*b* each located at an inner base end portion of the corresponding slit 16*a*. Each backpressure chamber 16*b* is formed substantially in a circular shape in cross section taken by a plane perpendicular to the axial direction. The discharge oil is introduced into the backpressure chambers 16*b*. Accordingly, each vane 17 is pushed in the radially outward direction by a pressure of the backpressure chamber 16*b* and a centrifugal force caused by the rotation of the rotor 16.

When the rotor 16 rotates, a tip surface of each vane 17 slides in contact with the inner circumferential surface of the cam ring 15, and a base end surface of each vane 17 slides in contact with outer circumferential surfaces of the respective ring members 18. That is, each vane 17 is pushed and pressed in the radially outer direction of the rotor 16 by the ring members 18. Hence, even when an engine speed is low or the centrifugal force and the pressure of the backpressure chambers 16*b* are low, the tip of each vane 17 slides on (slides in contact with) the inner circumferential surface of the cam ring 15 so that each pump room PR is separated liquid-tightly.

The cam ring 15 is made of so-called sintered metal and formed integrally in a substantially cylindrical shape. A predetermined part of the outer circumferential portion of the cam ring 15 is cut to form a groove-shaped (recessed) pivot portion 15*a* along the axial direction. The groove-shaped pivot portion 15*a* is formed in a substantially circular-arc shape in cross section, and is fitted over the pivot pin 19 so that a swing fulcrum is formed for varying an eccentricity amount of the cam ring 15. A part of the outer circumferential portion of the cam ring 15 which is located opposite to the groove-shaped pivot portion 15*a* with respect to the center of the cam ring 15 is formed with an arm portion 15*b* protruding in the radial direction of the cam ring 15. (i.e., the center of the cam ring 15 is located between the groove-shaped pivot portion 15*a* and the arm portion 15*b*) The arm portion 15*b* is linked to a first spring 33 and a second spring 34 which are provided at circumferentially both sides of the arm portion 15*b* to face each other. The first spring 33 has a predetermined spring constant, and the second spring 34 has a spring constant smaller than that of the first spring 33. One side portion of the arm portion 15*b* relative to movement directions (i.e., rotational directions) of the arm portion 15*b* is formed with a pressing protruding portion 15*c*. This pressing protruding portion 15*c* is formed in a substantially circular-arc shape in a bulging manner. Another side portion of the arm portion 15*b* relative to the movement directions of the arm portion 15*b* is formed with a pressing protrusion 15*d*. This pressing protrusion 15*d* extends in another movement direction of the arm portion 15*b* to have a length longer than a thickness (width) of an after-mentioned restricting portion 28. The arm portion 15*b* is linked to the first and second springs 33 and 34, when the pressing protruding portion 15*c* is in contact with a tip portion of the first spring 33 and the pressing protrusion 15*d* is in contact with a tip portion of the second spring 34.

As shown in FIGS. 4 and 5, the first and second spring receiving chambers 26 and 27 which respectively receive and retain the first and second springs 33 and 34 are provided adjacent to the pump accommodation chamber 13 in the pump body 11. The first and second spring receiving chambers 26 and 27 are located opposite to the supporting groove 11*c* relative to the drive shaft 14, and formed along the cam-ring eccentric-direction line N of FIG. 4. The first spring 33 is provided resiliently inside the first spring receiving chamber 26 between the arm portion 15*b* (the pressing protruding portion 15*c*) and an end wall of the first spring receiving chamber 26 so as to have a predetermined set load W1. The second spring 34 is provided resiliently inside the second spring receiving chamber 27 between the arm portion 15*b* (the pressing protrusion 15*d*) and an end wall of the second spring receiving chamber 27 so as to have a predetermined set load W2. A line diameter of the second spring 34 is smaller than that of the first spring 33. The restricting portion 28 is formed in a stepwise shape between the first and second spring receiving chambers 26 and 27. When another side portion of the arm portion 15*b* is in contact with one side portion of the restricting portion 28, the clockwise-directional rotation of the arm portion 15*b* is stopped (i.e., rotational range is restricted). On the other hand, when the tip portion of the second spring 34 is in contact with another side portion of the restricting portion 28, a maximum expansion amount of the second spring 34 is restricted (determined).

The cam ring 15 is always biased (urged) through the arm portion 15*b* by a resultant force W0 of both the set loads W1 and W2 of the springs 33 and 34. That is, the cam ring 15 mainly receives a biasing force of the first spring 33 which generates a relatively large spring load, and is biased in a direction (clockwise direction of FIG. 4) that increases the eccentricity amount of the cam ring 15. As shown in FIG. 4, under an inactive state of the swing of the cam ring 15, the pressing protrusion 15*d* of the arm portion 15*b* has entered into the second spring receiving chamber 27 so that the second spring 34 is compressed. In this state, the another side portion of the arm portion 15*b* is pressed to the one side portion of the restricting portion 28, so that the cam ring 15 is maintained at a location where the eccentricity amount of the cam ring 15 takes its maximum value. It is noted that a restricting section (or means) according to the present invention is constituted by a force acting in the direction that restricts or suppresses the movement of the cam ring 15 when the changeover control valve 40 is in positions except after-mentioned first and third positions, i.e., is constituted by a biasing force based on the spring load of the first spring 33 and a biasing force based on an internal pressure of the second control oil chamber 32.

Moreover, as shown in FIG. 4, the outer circumferential portion of the cam ring 15 is formed with a pair of first and second seal-constituting portions 15*e* and 15*f*. Each of the pair of first and second seal-constituting portions 15*e* and 15*f* is formed to protrude or bulge in the radial direction of the cam ring 15. The first seal-constituting portion 15*e* includes a first sealing surface 15*g* which is formed to face the first sealing slide-contact surface 11*d* constituted by the inner circumferential wall of the pump body 11. The second seal-constituting portion 15*f* includes a second sealing surface 15*h* which is formed to face the second sealing slide-contact surface 11*e* constituted by the inner circumferential wall of the pump body 11. Each of the first and second sealing surfaces 15*g* and 15*h* is formed in an circular-arc shape having a center identical with that of the circular-arc shape of the corresponding first or second sealing slide-contact surface 11*d*, 11*e*. The respective sealing surfaces 15*g* and 15*h* of the seal-constituting portions 15*e* and 15*f* are respectively formed with seal retaining grooves 15*i* by cutting or notching the sealing surfaces 15*g* and 15*h* along the axial direction. A first sealing member 20*a* which slides on the first sealing slide-contact surface 11*d* at the time of eccentric swing of the cam ring 15 is received and held in the seal retaining groove 15*i* of the first sealing surface 15*g*. Similarly, a second sealing member 20*b* which slides on the second sealing slide-contact surface 11*e* is received and held in the seal retaining groove 15*i* of the second sealing surface 15*h*.

As shown in FIGS. 4 and 5, the first sealing surface 15*g* has a predetermined radius r1 slightly smaller than the radius R1 of the first sealing slide-contact surface 11*d*, and the second sealing surface 15*h* has a predetermined radius r2 slightly smaller than the radius R2 of the second sealing slide-contact surface 11*e*. Hence, a predetermined minute clearance is formed between the first sealing slide-contact surface 11*d* and the first sealing surface 15*g*, and a predetermined minute clearance is formed between the second sealing slide-contact surface 11*e* and the second sealing surface 15*h*. Each of the first and second sealing members 20*a* and 20*b* is made of, for example, fluorine-series resin having a low frictional property, and is formed in a straightly-linear and narrow shape along the axial direction of the cam ring 15. Each of the first and second sealing members 20*a* and 20*b* is pressed to the sealing slide-contact surface 11*d* or 11*e* by elastic force of an elastic member provided at a bottom portion of the corresponding seal retaining groove 15*i*. This elastic member is, for example, made of rubber. Accordingly, the clearance between the first sealing slide-contact surface 11*d* and the first sealing surface 15*g* and the clearance between the second sealing slide-contact surface 11*e* and the second sealing surface 15*h* are sealed liquid-tightly.

The pair of first and second control oil chambers 31 and 32 are formed in a region radially outside the cam ring 15 (i.e., on the outer circumferential surface of the cam ring 15), and are separated from each other by the pivot pin 19 and the first and second sealing members 20*a* and 20*b*. The discharge pressure is introduced through the changeover control valve 40 into the respective control oil chambers 31 and 32. Then, the discharge pressure is applied to first and second pressure-receiving surfaces 15*j* and 15*k* which are constituted by portions of the outer circumferential surface of the cam ring 15 that face the control oil chambers 31 and 32, and thereby, a swinging force (displacement) is given to the cam ring 15. The first pressure-receiving surface 15*j* has an area larger than that of the second pressure-receiving surface 15*k*. Hence, in a case where the same oil pressure is applied to the first and second pressure-receiving surfaces 15*j* and 15*k*, the cam ring 15 can be urged in a direction (counterclockwise direction of FIG. 4) that reduces the eccentricity amount of the cam ring 15, as a whole. That is, in this case, although the internal pressures of the control oil chambers 31 and 32 are applied through the first and second pressure-receiving surfaces 15*j* and 15*k* to the cam ring 15 in directions opposite to each other, the cam ring 15 is biased in the direction that brings the center of the inner circumferential surface of the cam ring 15 closer to the rotational center of the rotor 16. (Hereinafter, this direction will be referred to as "concentric direction") Thereby, the displacement control of the cam ring 15 is achieved in the concentric direction.

Thus, in the oil pump 10, the biasing force in the eccentric direction which is based on the spring force of the first spring 33 and the internal pressure of the control oil chamber 32 is balanced in a force relationship with the basing force in the concentric direction which is based on the spring load of the second spring 34 and the internal pressure of the control oil chamber 31. If the biasing force based on the internal pressures of the control oil chambers 31 and 32 is smaller than the resultant force W0 (=W1-W2) which is a difference between the set load W1 of the first spring 33 and the set load W2 of the second spring 34, the cam ring 15 is in the maximum eccentric state as shown in FIG. 4. On the other hand, if the biasing force based on the internal pressures of the control oil chambers 31 and 32 becomes larger than the resultant force W0 of the set loads of the springs 33 and 34 with a rise of the discharge pressure, the cam ring 15 moves in the concentric direction in response to the level of the discharge pressure.

Figure 7:
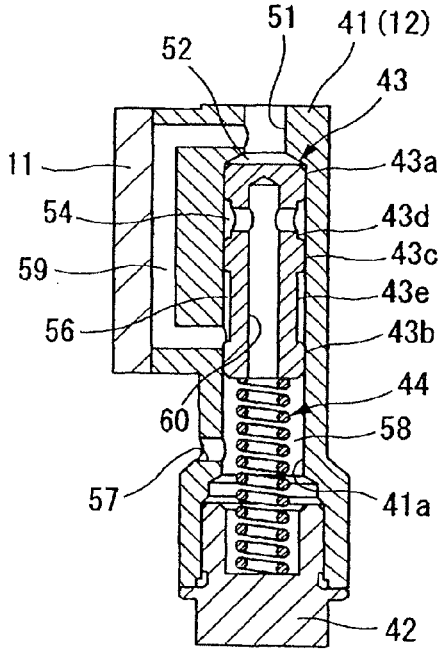
FIG. 7 is a cross-sectional view of FIG. 2, taken along a line C-C of FIG. 2 (as viewed in a direction of arrows C and C).

As shown in FIG. 7, the changeover control valve 40 mainly includes valve body 41 formed in a substantially circular-tube shape, a plug 42, a spool valving element 43 formed in a substantially hollow shape, and a valve spring 44. The valve body 41 is provided to a radially outer portion of the cover member 12. One end side of the valve body 41 with respect to an axial direction of the changeover control valve 40 is formed in a diameter-enlarging manner, and another end side of the valve body 41 with respect to the axial direction of the changeover control valve 40 is formed in a diameter-reducing manner. Both the axial ends of the tube-shaped valve body 41 are open. The opening of the one end side of the valve body 41 is enclosed by the plug 42. The spool valving element 43 is accommodated in the valve body 41 to be able to slide in contact with an inner circumferential surface of the valve body 41 in the axial direction of the changeover control valve 40. The spool valving element 43 includes first to third land portions 43*a* to 43*c* which are three large-diameter portions configured to slide on the inner circumferential surface of the valve body 41. By these first to third land portions 43*a* to 43*c*, the changeover (switching) of oil passages leading to the control oil chambers 31 and 32 is performed. The valve spring 44 is resiliently provided between the plug 42 and the valving element 43 inside the one end side of the valve body 41. The valve spring 44 has a predetermined set load Wk, and thereby, constantly biases the valving element 43 toward the another end side of the valve body 41.

The valve body 41 is formed with a valve receiving portion 41*a* existing over a range except axially both end portions of the valve body 41. The valve receiving portion 41*a* is drilled in a waistless shape having an inner diameter substantially equal to an outer diameter of the spool valving element 43 (=outer diameter of the land portions 43*a* to 43*c*). The spool valving element 43 is accommodated and received in the valve receiving portion 41*a*. One end portion of the valve body 41 which is formed in the diameter-enlarging manner as mentioned above is formed with a female thread portion. The plug 42 is screwed into this female thread portion. On the other hand, another end portion of the valve body 41 which is formed in the diameter-reducing manner as mentioned above is formed with a feeding port 51 which is open to an external of the valve body 41. The feeding port 51 is connected through an oil passage provided inside an engine block (not shown), to the discharge port 22*a*. An inner circumferential wall of the valve receiving portion 41*a* is formed with a first supplying/draining port 53 and a second supplying/draining port 55 which are open to the external of the valve body 41. The first supplying/draining port 53 functions to supply or drain oil pressure to/from the first control oil chamber 31 by switching between a connection of the first control oil chamber 31 and an after-mentioned pressure chamber 52 and a connection of the first control oil chamber 31 and an after-mentioned draining relay chamber 54. The second supplying/draining port 55 functions to supply or drain oil pressure to/from the second control oil chamber 32 by switching between a connection of the second control oil chamber 32 and an after-mentioned supplying relay chamber 56 and a connection of the second control oil chamber 32 and the draining relay chamber 54. Moreover, a drain port 57 is formed at a portion of a circumferential wall of the one end side of the valve body 41 which overlaps with an after-mentioned backpressure chamber 58 in a radial direction of the changeover control valve 40. The drain port 57 functions as a draining means, and connects (communicates) the backpressure chamber 58 to the suction side or directly to an external open space.

A communication oil passage 59 is formed in a circumferential wall portion of the another end side of the valve body 41. The communication oil passage 59 cooperates with the pomp body 11 to cause the feeding port 51 to communicate with the supplying relay chamber 56 under a condition where the spool valving element 43 is positioned in its upper end side of FIG. 7, more specifically, under states of the first position shown in FIG. 9A and the second position shown in FIG. 9B. That is, the valve body 41 is formed with the communication oil passage 59 which includes radial oil passages 59*a* and 59*b* and a connecting oil passage 59*c*. The radial oil passage 59*a* is formed to extend in the radial direction of the changeover control valve 40 from a predetermined location open to the feeding port 51. The radial oil passage 59*b* is formed to extend in the radial direction of the changeover control valve 40 from a predetermined location open to the supplying relay chamber 56 under the condition where the spool valving element 43 is positioned in its upper end side of FIG. 7. The connecting oil passage 59*c* is formed in a groove shape in the inside surface of the cover member 12. By binding the cover member 12 to the pump body 11, the radial oil passages 59*a* and 59*b* are connected with each other by the connecting oil passage 59*c* formed between the pump body 11 and the cover member 12.

The spool valving element 43 includes the three first to third land portions 43*a* to 43*c* at axially both end portions and axially middle portion of the spool valving element 43. The spool valving element 43 includes a first shaft portion 43*d* between the first and third land portions 43*a* and 43*c*, and a second shaft portion 43*e* between the second and third land portions 43*b* and 43*c*, which are small-diameter portions. Since the spool valving element 43 is accommodated in the valve receiving portion 41*a*; the pressure chamber 52, the backpressure chamber 58, the draining relay chamber 54 and the supplying relay chamber 56 are formed separately inside the valve body 41. The pressure chamber 52 is located between the another end portion of the valve body 41 and the first land portion 43*a*, axially outside the first land portion 43*a*. The discharge pressure is fed from the feeding port 51 to the pressure chamber 52. The backpressure chamber 58 is located between the plug 42 and the second land portion 43*b*, axially outside the second land portion 43*b*. The backpressure chamber 58 drains oil which has been drained from the first control oil chamber 31 through an after-mentioned inside oil passage 60 and the like. The draining relay chamber 54 is located radially outside the first small-diameter portion 43*d* (i.e., located on an outer circumferential surface of the first small-diameter portion 43*d*), and has an annular shape. The draining relay chamber 54 functions to cause the backpressure chamber 58 to communicate with the control oil chambers 31 and 32. The supplying relay chamber 56 is located radially outside the second small-diameter portion 43*e* (i.e., located on an outer circumferential surface of the second small-diameter portion 43*e*), and has an annular shape. The supplying relay chamber 56 functions to cause the pressure chamber 52 to communicate with the control oil chambers 31 and 32.

The inside oil passage 60 is formed inside the spool valving element 43, and is formed as a communication passage in a substantially T shape in cross section taken by a plane parallel to the axial direction of the changeover control valve 40. Axially one end of the inside oil passage 60 is open to a plurality of spots of the outer circumferential surface of the first shaft portion 43*d*, i.e., open to the draining relay chamber 54. Axially another end of the inside oil passage 60 is open to an axially outer surface of the second large-diameter portion 43*b*, i.e., open to the backpressure chamber 58. Accordingly, oil within the first or second control oil chamber 31, 32 connected with the draining relay chamber 54 is introduced through the inside oil passage 60 into the drain port 57.

Figure 9A:
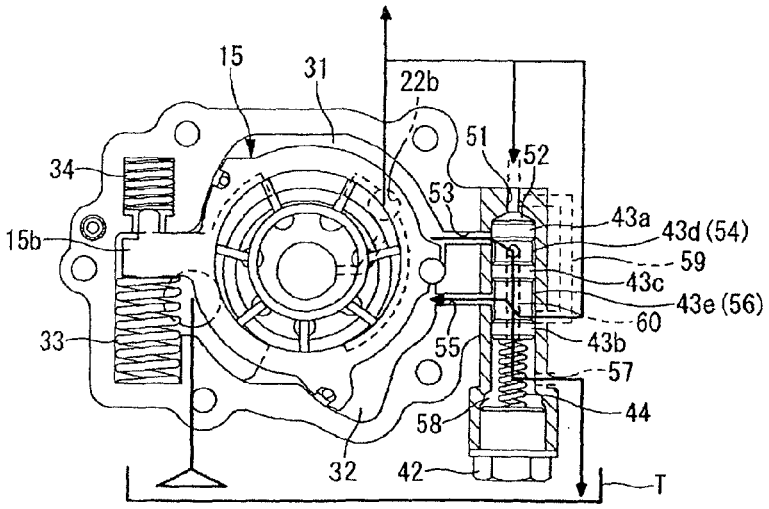
FIG. 9A is an oil-pressure circuit diagram of the variable displacement pump under a state where a changeover control valve is in its first position, according to the first embodiment.

Therefore, as shown in FIG. 9A, the spool valving element 43 of the changeover control valve 40 is placed in the first position defined by a predetermined range (endmost range) of the another end side of the valve receiving portion 41*a*, by the biasing force W (set load Wk) of the valve spring 44, under a state where the discharge pressure has not been introduced into the pressure chamber 52 and the supplying relay chamber 56 or under a state where the discharge pressure introduced into the pressure chamber 52 and the like is sufficiently low. That is, when the spool valving element 43 is in the first position, the first supplying/draining port 53 is connected with (i.e., communicates with) the draining relay chamber 54 by the first land portion 43*a*, so that oil within the first control oil chamber 31 is drained through the draining relay chamber 54 and the inside oil passage 60 to the oil pan T or the like. Moreover, in this state (under the first position), the second supplying/draining port 55 is connected with (i.e., communicates with) the supplying relay chamber 56 by the third land portion 43*c*, so that oil (the discharge pressure) fed through the communication oil passage 59 is supplied through the supplying relay chamber 56 to the second control oil chamber 32.

Figure 9B:
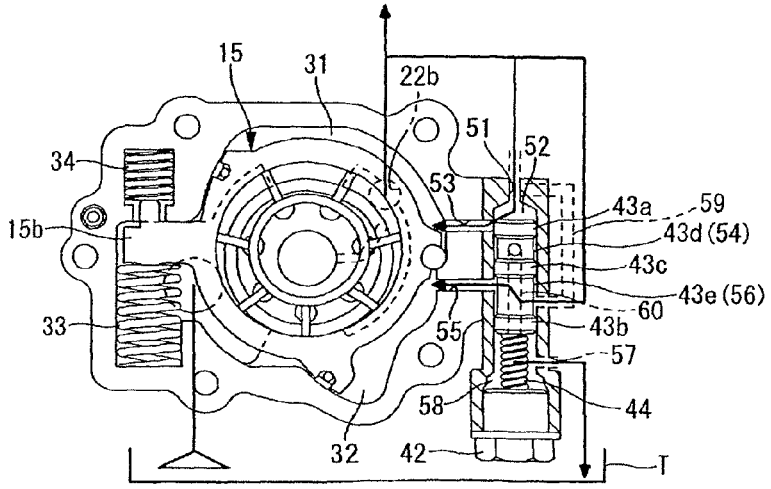
FIG. 9B is an oil-pressure circuit diagram of the variable displacement pump under a state where the changeover control valve is in its second position, according to the first embodiment.

Next, when the discharge pressure introduced into the pressure chamber 52 and the like becomes high, as shown in FIG. 9B, the spool valving element 43 moves from the first position toward the one end side of the valve receiving portion 41*a* against the biasing force W (set load Wk) of the valve spring 44, and then, takes the second position which is an intermediate position. Under this second position, the first supplying/draining port 53 is connected with (communicates with) the pressure chamber 52 by the first land portion 43*a*, so that a part of the discharge pressure introduced into the pressure chamber 52 is supplied through the first supplying/draining port 53 to the first control oil chamber 31. Moreover, in this state (under the second position), the connection (communication) between the second supplying/draining port 55 and the supplying relay chamber 56 is maintained by the third land portion 43*c*, so that the discharge pressure is continuously supplied through the communication oil passage 59 and the supplying relay chamber 56 to the second control oil chamber 32.

Figure 9C:
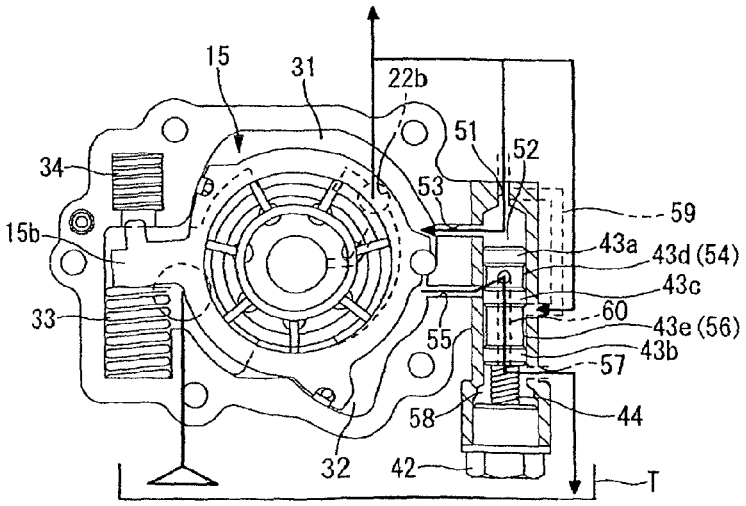
FIG. 9C is an oil-pressure circuit diagram of the variable displacement pump under a state where the changeover control valve is in its third position, according to the first embodiment.

Next, when the discharge pressure introduced into the pressure chamber 52 and the like becomes much higher, as shown in FIG. 9C, the spool valving element 43 further moves from the second position toward the one end side of the valve receiving portion 41*a* against the biasing force W of the valve spring 44, and then, takes the third position which is defined by a predetermined range deviated toward the one end side of the valve receiving portion 41*a*. Under this third position, the connection (communication) between the first supplying/draining port 53 and the pressure chamber 52 is maintained by the first land portion 43*a*, so that the discharge pressure is continuously supplied to the first control oil chamber 31. Moreover, in this state (under the third position), the second supplying/draining port 55 is connected with (communicates with) the draining relay chamber 54 by the third land portion 43*c*, so that oil within the second control oil chamber 32 is drained through the draining relay chamber 54 and the inside oil passage 60 to the oil pan T or the like.

Operations of the oil pump 10 according to the first embodiment will be explained referring to FIGS. 8 and 9.

At first, a needed oil-pressure level of the internal combustion engine will now be explained which is used as a reference for a discharge-pressure control of the oil pump 10. In FIG. 8, a reference sign P1 denotes a first desired oil pressure of the engine which corresponds to, for example, a desired oil pressure of a valve-timing control device in a case that the valve-timing control device is employed for improving a fuel economy (fuel consumption) or the like. A reference sign P2 of FIG. 8 denotes a second desired oil pressure of the engine which corresponds to, for example, a desired oil pressure of an oil jet in a case that the oil jet is employed for cooling a piston of the engine. A reference sign P3 of FIG. 8 denotes a third desired oil pressure of the engine which is necessary for lubricating a bearing portion of the crankshaft at the time of high-speed rotation of the engine. An alternate long and short dash line which connects these three points P1 to P3 with each other shows an ideal needed oil pressure (ideal discharge pressure) P according to an engine rotational speed R of the internal combustion engine. A solid line of FIG. 8 shows an oil-pressure characteristic of the oil pump 10 according to the present invention. A dotted line of FIG. 8 shows an oil-pressure characteristic of pump in earlier technology.

Figure 8:
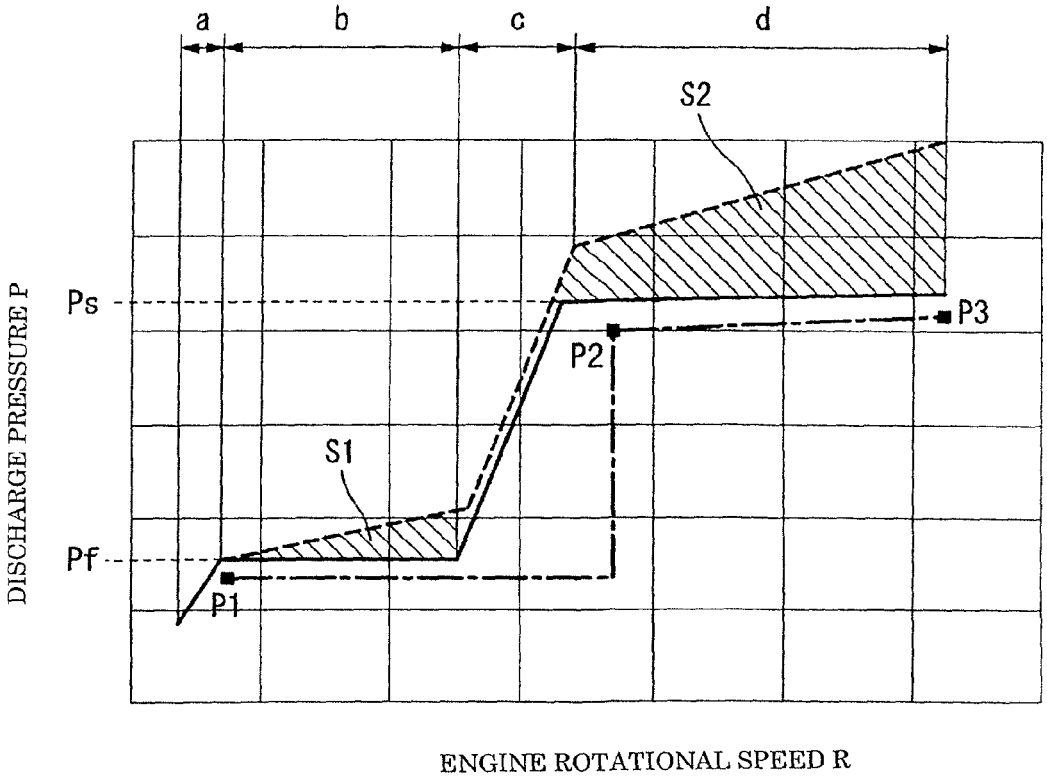
FIG. 8 is a graph showing an oil-pressure characteristic of the variable displacement pump in the first embodiment.

A reference sign Pf of FIG. 8 denotes a first changeover oil pressure at which the spool valving element 43 starts to move from the first position to the second position against the biasing force W (set load Wk) of the valve spring 44. A reference sign Ps denotes a second changeover oil pressure at which the spool valving element 43 further starts to move from the second position to the third position against the biasing force W of the valve spring 44. Under the state where both the biasing forces W1 and W2 of the first and second springs 33 and 34 are being applied to the cam ring 15 as shown in FIG. 9A, a value of oil pressure (hereinafter referred to as "first operating oil pressure") which can (start to) move the cam ring 15 is lower than the first changeover oil pressure Pf. Under the state where only the biasing force W1 of the first spring 33 is being applied to the cam ring 15 nearly as shown in FIG. 9B, a value of oil pressure (hereinafter referred to as "second operating oil pressure") which can (start to) move the cam ring 15 (toward a state of FIG. 9C) is higher than the second changeover oil pressure Ps. That is, the spring loads of the springs 33 and 34 and areas (dimensions) of the pressure-receiving surfaces 15*j* and 15*k* of the control oil chambers 31 and 32 are set or designed to satisfy the above-mentioned relations among the first and second operating oil pressures and the first and second changeover oil pressures Pf and Ps.

In a zone "a" of FIG. 8 which corresponds to an engine rotational-speed range from an engine start to an engine low-speed region, the discharge pressure (oil pressure in the engine) P is lower than the first changeover oil pressure Pf. Hence, the spool valving element 43 of the changeover control valve 40 exists in the first position as shown in FIG. 9A, so that the first supplying/draining port 53 of the changeover control valve 40 communicates through the draining relay chamber 54 and the inside oil passage 60 with the drain port 57 and that the second supplying/draining port 55 communicates through the supplying relay chamber 56 and the communication oil passage 59 with the feeding port 51. As a result, oil of the first control oil chamber 31 is drained to the oil pan T, and the discharge pressure P is supplied only to the second control oil chamber 32. Hence, by the biasing force based on the internal pressure of the second control oil chamber 32 and by the resultant force W0 of both the springs 33 and 34 (i.e., by the biasing force based on the relatively-large spring load of the first spring 33); the cam ring 15 is held under the maximum eccentric state where the arm portion 15*b* is in contact with the restricting portion 28. Thereby, a discharge amount of the pump is in its maximum state, and the discharge pressure P increases substantially proportional to the rise of the engine rotational speed R.

Then, when the discharge pressure P reaches the first changeover oil pressure Pf with the rise of the engine rotational speed R, the spool valving element 43 in the changeover control valve 40 moves toward the plug 42 against the biasing force W of the valve spring 44, so that the spool valving element 43 takes the second position instead of the first position as shown in FIG. 9B. Thereby, the first supplying/draining port 53 communicates through the pressure chamber 52 with the feeding port 51 while the communication (connection) between the second supplying/draining port 55 and the feeding port 51 is maintained. Hence, the discharge pressure P comes to be supplied to both of the control oil chambers 31 and 32. However, an opening amount (a flow-passage area) of the communication between the first supplying/draining port 53 and the pressure chamber 52 is not yet sufficient. Hence, an oil-pressure level Px slightly lower than the first changeover oil pressure Pf is supplied to the first control oil chamber 31. Since the first operating oil pressure of the cam ring 15 is set to be lower than the first changeover oil pressure Pf as mentioned above, the oil-pressure level Px can operate (move) the cam ring 15 in this state. That is, the biasing force based on the internal pressure of the control oil chamber 31 stars to overcome a resultant force (hereinafter referred to as "first biasing force acting in the eccentricity-increasing direction") between the biasing force based on the internal pressure of the second control oil chamber 32 and the biasing forces W1 and W2 of the first and second springs 33 and 34. Thereby, the cam ring 15 starts to move in the concentric direction.

Thereby, the discharge pressure P is reduced with the decrease of eccentricity amount of the cam ring 15 caused by the movement of the cam ring 15 in the concentric direction, so that the biasing force based on the discharge pressure P becomes lower than the biasing force of the valve spring 44. As a result, the spool valving element 43 is returned from the second position back to the first position by the basing force W of the valve spring 44. The first supplying/draining port 53 is disconnected from the pressure chamber 52 by the first land portion 43*a* of the backwardly-pushed spool valving element 43, so that the first supplying/draining port 53 is again connected through the draining relay chamber 54 with the drain port 57. As a result, oil within the first control oil chamber 31 is drained to reduce the internal pressure of the first control oil chamber 31. Thereby, the biasing force based on the internal pressure of the first control oil chamber 31 becomes lower than the first biasing force acting in the eccentricity-increasing direction, so that the cam ring 15 again becomes in the maximum eccentric state as shown in FIG. 9A. Then, the discharge pressure P is again increased because of this maximum eccentric state so that the biasing force based on the discharge pressure P comes to overcome (be larger than) the biasing force W of the valve spring 44 based on the set load Wk. Hence, the spool valving element 43 again moves toward the plug 42 against the biasing force W of the valve spring 44 to take the second position instead of the first position. As a result, the cam ring 15 again moves in the concentric direction.

By so doing, the spool valving element 43 of the changeover control valve 40 switches in continuously alternate shifts between the connection between the first supplying/draining port 53 and the draining relay chamber 54 (the drain port 57) and the connection between the first supplying/draining port 53 and the pressure chamber 52 (feeding port 51). Thereby, the discharge pressure P is adjusted and maintained to be equal to the first changeover oil pressure Pf. Since such a pressure adjustment is conducted by the switching of the first supplying/draining port 53 in the changeover control valve 40, the adjustment of the discharge pressure P does not receive an influence caused due to spring constants of the first and second springs 33 and 34. Moreover, this adjustment of the discharge pressure P does not receive an influence caused by a spring constant of the valve spring 44 since such a pressure adjustment is conducted in an extremely narrow stroke range of the spool valving element 43 for the switching of the first supplying/draining port 53. As a result, the discharge pressure P of the oil pump 10 according to the first embodiment has an approximately flat characteristic, and does not increase proportional to the rise of the engine rotational speed R as the earlier-technology pump shown by dotted line in FIG. 8. That is, the discharge pressure P according to the first embodiment can considerably approach the ideal needed oil pressure (shown by the alternate long and short dash line). Therefore, the oil pump 10 according to the first embodiment of the present invention can reduce a power loss (a range S1 hatched in zone "b" of FIG. 8) which is caused due to a futile increase of the discharge pressure P, as compared with the earlier-technology oil pump in which the discharge pressure P is forced to increase with the rise of the engine rotational speed R by an amount corresponding to (compensating for) the spring constant of the first spring 33.

When the discharge pressure P increases with the rise of the engine rotational speed R under the state where the changeover control valve 40 is in the second position, the first supplying/draining port 53 comes to sufficiently communicate with the pressure chamber 52. At this time, the internal pressure of the first control oil chamber 31 is increased, and thereby the cam ring 15 moves in the concentric direction, so that the tip of the second spring 34 becomes in contact with the restricting portion 28 (see FIG. 9B). That is, an aid force of the second spring 34 is eliminated so that the movement of the cam ring 15 in the concentric direction is stopped. As a result, the discharge pressure P again increases substantially proportional to the engine rotational speed R, with the rise of the engine rotational speed R (a zone "c" of FIG. 8).

As mentioned above, the second changeover oil pressure Ps is set at a value lower than the second operating oil pressure of the cam ring 15. Hence, when the discharge pressure P further increases by a further rise of the engine rotational speed R and reaches the second changeover oil pressure Ps, the spool valving element 43 of the changeover control valve 40 further moves toward the plug 42 so as to take the third position instead of the second position as shown in FIG. 9C. Thereby, the second supplying/draining port 55 communicates with the draining relay chamber 54 (the drain port 57) by the third land portion 43*c* while the communication (connection) between the first supplying/draining port 53 and the pressure chamber 52 (the feeding port 51) is maintained. Accordingly, the discharge pressure P is introduced into the first control oil chamber 31, and oil is drained from the second control oil chamber 32. As a result, the biasing force based on the internal pressure of the first control oil chamber 31 becomes higher than a resultant force (hereinafter referred to as "second biasing force acting in the eccentricity-increasing direction") between the biasing force based on the internal pressure of the second control oil chamber 32 and the biasing force W1 of the first spring 33. Thereby, the cam ring 15 starts to move further in the concentric direction.

Then, the discharge pressure P decreases with the decrease of eccentricity amount of the cam ring 15 caused by the movement of the cam ring 15 in the concentric direction, so that the biasing force based on the discharge pressure P becomes lower than the biasing force W of the valve spring 44. As a result, the spool valving element 43 is returned from the third position back to the second position by the basing force W of the valve spring 44. Thereby, the second supplying/draining port 55 is disconnected from the draining relay chamber 54 by the third land portion 43*c* of the backwardly-pushed spool valving element 43, so that the second supplying/draining port 55 is again connected with the supplying relay chamber 56 (the feeding port 51). Thereby, the discharge pressure P is again introduced also into the second control oil chamber 32 to enlarge the internal pressure of the second control oil chamber 32. As a result, the biasing force based on the internal pressure of the first control oil chamber 31 becomes lower than the second biasing force acting in the eccentricity-increasing direction, so that the cam ring 15 again becomes in a medium eccentric state as shown in FIG. 9B. Then, the discharge pressure P is again increased because of this medium eccentric state (i.e., because of the increase of eccentricity amount) so that the biasing force based on the discharge pressure P comes to overcome (be larger than) the biasing force W of the valve spring 44. Hence, the spool valving element 43 again moves toward the plug 42 against the biasing force W of the valve spring 44 to take the third position instead of the second position. As a result, the cam ring 15 again moves in the concentric direction (a zone "d" of FIG. 8).

By so doing, the spool valving element 43 of the changeover control valve 40 switches in continuously alternate shifts between the connection between the second supplying/draining port 55 and the draining relay chamber 54 (the drain port 57) and the connection between the second supplying/draining port 55 and the feeding port 51. Thereby, the discharge pressure P is adjusted and maintained to be equal to the second changeover oil pressure Ps. Since such a pressure adjustment is conducted by the switching of the second supplying/draining port 55 in the changeover control valve 40, the adjustment of the discharge pressure P does not receive the influence caused due to spring constants of the first and second springs 33 and 34. Moreover, this adjustment of the discharge pressure P does not receive an influence caused by the spring constant of the valve spring 44 since such a pressure adjustment is conducted in an extremely narrow stroke range of the spool valving element 43 for the switching of the second supplying/draining port 55. As a result, in the same manner as the case of the zone "b", the discharge pressure P of the oil pump 10 according to the first embodiment has a substantially flat characteristic in graph, and does not increase proportional to the rise of the engine rotational speed R as the earlier-technology pump shown by dotted line in FIG. 8. That is, the discharge pressure P according to the first embodiment can considerably approach the ideal needed oil pressure. Therefore, the oil pump 10 according to the first embodiment of the present invention can reduce a power loss (a range S2 hatched in FIG. 8) which is caused due to a futile increase of the discharge pressure P, as compared with the earlier-technology oil pump in which the discharge pressure P is forced to increase with the rise of the engine rotational speed R by an amount corresponding to (compensating for) the spring constant of the first spring 33.

Therefore, the oil pump 10 in the first embodiment can maintain the discharge pressure P at its desired constant levels (the first and second changeover oil pressures Pf and Ps), in engine rotational speed regions (the zones "b" and "d" of FIG. 8) over which the discharge pressure P is required to be maintained at the desired constant levels.

According to the this embodiment, in the case that the discharge pressure P is higher than or equal to the first operating oil pressure of the cam ring 15 and lower than or equal to the first changeover oil pressure Pf, the spool valving element 43 moves from the first position to the second position when the discharge pressure P becomes higher than or equal to the first changeover oil pressure Pf. By this movement of the spool valving element 43, the eccentricity amount of the cam ring 15 is reduced, so that the discharge pressure P again becomes lower than the first changeover oil pressure Pf to bring the spool valving element 43 back to the first position. Since such a connection changeover of the first supplying/draining port 53 is repeated by the spool valving element 43 (by the first land portion 43*a*), the discharge pressure P can be maintained at the level of the first changeover oil pressure Pf.

Similarly, in the case that the discharge pressure P is higher than or equal to the second changeover oil pressure Ps and lower than or equal to the second operating oil pressure of the cam ring 15, the connection changeover of the second supplying/draining port 55 is repeated by the spool valving element 43. Thus, the discharge pressure P can be maintained at the level of the second changeover oil pressure Ps.

Since such a pressure adjustment is performed by the changeover control valve 40, this pressure adjustment is not influenced by the spring constants of the first and second springs 33 and 34, as is different from the earlier technology. Moreover, this pressure adjustment is not influenced by the spring constant of the valve spring 44 since such a pressure adjustment is performed in an extremely narrow stroke range of the spool valving element in the changeover control valve 40. In other words, the discharge pressure P is not increased without avail by the influence of (increment amount calculated by) spring constants of the first and second springs 33 and 34 and the valve spring 44 (mainly, by the influence of the first spring 33). Thus, the desired levels of discharge pressure can be obtained and maintained.

Moreover, according to the oil pump 10 in the first embodiment, when the changeover control valve 40 (spool valving element 43) is in the first position, the first control oil chamber 31 communicates with the drain port 57 to drain oil within the first control oil chamber 31 so that the discharge pressure P is introduced only to the second control oil chamber 32. By such a structure, unstable actions such as a flap of the cam ring 15 which are caused when oil pressure is supplied and applied to both the control oil chambers 31 and 32 are suppressed, so that a stable retention of the cam ring 15 can be achieved. Thus, a control of the discharge pressure can be stabilized in the zone "a".

Moreover, according to the oil pump 10 in the first embodiment, the control oil chambers 31 and 32 are separately formed between the inner circumferential surface of the pump body 11 and the outer circumferential surface of the cam ring 15, and the cam ring 15 is controllably swung depending on dimensions (areas) of the pressure-receiving surfaces 15*j* and 15*k* respectively provided to the outer circumferential portion of the cam ring 15. Accordingly, the swing of the cam ring 15 can be controlled in a simplified structure so that the pump structure is simplified.

Moreover, according to the oil pump 10 in the first embodiment, the discharge pressure P is applied only to the another end side of the spool valving element 43 in the changeover control valve 40, and the inside oil passage 60 formed inside the spool valving element 43 is open to the one end side of the spool valving element 43. Accordingly, oil of the draining relay chamber 54 leading to the first shaft portion 43*d* is guided through the inside oil passage 60 to the drain port 57. By such a structure, a dedicated land portion for opening and closing the drain port 57 is unnecessary, so that an axial length of the spool valving element can be shortened by a length of this unnecessary land portion. Therefore, the changeover control valve 40 can be downsized to enhance the downsizing of the oil pump 10.

Figure 10:
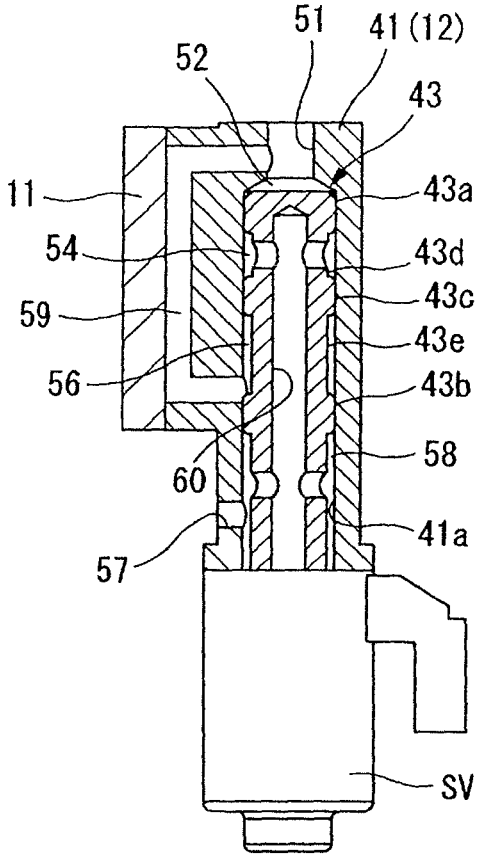
FIG. 10 is a cross-sectional view of a changeover control valve in a variable displacement pump in a second embodiment according to the present invention, taken by a plane parallel to an axial direction of the changeover control valve, and corresponds to FIG. 7 of the first embodiment.

FIG. 10 shows a variable displacement oil pump in a second embodiment according to the present invention. In this second embodiment, the changeover control valve 40 is a solenoid valve SV which operates based on exciting current derived from a vehicle-mounted ECU (not shown) according to an operating state of the engine. That is, the above-mentioned changeover control is electrically performed by driving and controlling the spool valving element 43 by use of the solenoid valve SV. The solenoid valve SV performs the changeover control of the changeover control valve 40 on the basis of rotational speed, water temperature, oil temperature, oil pressure or the like of the internal combustion engine which are sensed by predetermined sensors or the like. Specifically, the changeover control is carried out based on a map corresponding to the graph shown by the solid line in FIG. 8, with reference to parameters of engine rotational speed and oil pressure which have been directly sensed or which have been estimated (calculated) from the water temperature and oil temperature.

Thus, the changeover control by the changeover control valve 40 is performed electrically by using the solenoid valve SV in the second embodiment. Hence, the changeover control does not receive an influence of characteristic change of oil pressure which is caused due to abrasions of respective parts of the pump or a change of oil type, as compared with the case where the changeover control is performed by the discharge pressure as in the first embodiment. Accordingly, the changeover control can be performed always appropriately. Therefore, smooth and quick operation of the cam ring 15 is attained in the zone "b" of FIG. 8 in particular. Hence, the power loss of the pump can be suppressed more effectively in the zone "b", so that the fuel economy (fuel consumption) can be further improved.

Moreover, according to the second embodiment, the solenoid valve SV is controlled based on the water temperature, the oil temperature, the rotational speed and the like of the internal combustion engine. Therefore, the control of the changeover control valve 40 can be performed more properly.

Although the invention has been described above with reference to certain embodiments of the invention, the invention is not limited to the embodiments described above. Modifications and variations of the embodiments described above will occur to those skilled in the art in light of the above teachings.

For example, each of the values P1 to P3 of the desired oil pressure of the engine and the first and second changeover oil pressures Pf and Ps can be changed freely according to specifications of the internal combustion engine or the valve-timing control device or the like of the vehicle in which the oil pump 10 is mounted.

In the above first and second embodiments, the discharge amount is varied by swinging the cam ring 15. However, the structure according to the present invention is not limited to this. For example, the discharge amount may be varied by moving the cam ring 15 linearly in the radial direction. In other words, the structure according to the present invention can employ any moving structure of the cam ring 15 which can vary the discharge amount (i.e., any structure capable of changing a volume variation rate of the pump room PR).

Moreover, the restricting means is constituted by the force acting in the direction that suppresses the movement of the cam ring 15 in the above first and second embodiments. However, the structure according to the present invention is not limited to this. For example, the restricting means may be constituted by a restricting member such as a lock pin which physically restricts the movement of the cam ring 15.

Some technical structures obtainable from the above embodiments according to the present invention will now be listed with their advantageous effects.

[a] A variable displacement oil pump comprising: a rotor (e.g., 16 in the drawings) configured to be rotationally driven; a plurality of vanes (17) movable out from and into an outer circumferential portion of the rotor (16); a cam ring (15) separately forming a plurality of working-oil rooms by receiving the rotor (16) and the plurality of vanes (17) in an inner circumferential space of the cam ring (15), wherein the cam ring (15) is configured to move to vary an eccentricity between a rotation center of the rotor (16) and a center of an inner circumferential surface of the cam ring (15) and thereby to vary a variation rate of volume of each of the plurality of working-oil rooms which is produced when the rotor (16) rotates; a lateral wall provided on at least one of lateral portions of the cam ring (15), wherein the lateral wall includes a suction portion (21*a*, 21*c*) open to the working-oil room whose volume is increasing when the rotor (16) is rotating under a state where the cam ring (15) is eccentric, and a discharge portion (22*a*, 22*c*) open to the working-oil room whose volume is decreasing when the rotor (16) is rotating under the state where the cam ring (15) is eccentric; a first control oil chamber (31) configured to apply a first biasing force to the cam ring (15) in a direction that reduces the eccentricity between the rotation center of the rotor (16) and the center of the inner circumferential surface of the cam ring (15), by oil discharged and introduced from the discharge portion (22*a*, 22*c*) into the first control oil chamber (31); a second control oil chamber (32) configured to apply a second biasing force to the cam ring (15) in a direction that enlarges the eccentricity between the rotation center of the rotor (16) and the center of the inner circumferential surface of the cam ring (15), by oil discharged and introduced from the discharge portion (22*a*, 22*c*) into the second control oil chamber (32), wherein the second biasing force is smaller than the first biasing force; a biasing mechanism (33, 34) configured to apply a third biasing force to the cam ring (15) in the direction that enlarges the eccentricity between the rotation center of the rotor (16) and the center of the inner circumferential surface of the cam ring (15) under a state where the biasing mechanism (33, 34) is given a set load, wherein the biasing mechanism (33, 34) is configured to increase the third biasing force discontinuously in a stepwise manner when the eccentricity between the rotation center of the rotor (16) and the center of the inner circumferential surface of the cam ring (15) becomes lower than or equal to a predetermined amount; and a changeover mechanism (40) including a valving element (43) receiving a fourth biasing force in a direction toward a first position of the valving element (43) and configured to move against the fourth biasing force by a discharge pressure discharged from the discharge portion (22*a*, 22*c*), configured to connect the first control oil chamber (31) with a drain portion (57) when the valving element (43) is in the first position, configured to introduce the discharge pressure into the first control oil chamber (31) and the second control oil chamber (32) when the valving element (43) moves and reaches a second position thereof against the fourth biasing force, and configured to drain a part of oil of the second control oil chamber (32) to the drain portion (57) and to continue to introduce the discharge pressure into the first control oil chamber (31) when the valving element (43) moves from the second position and reaches a third position thereof against the fourth biasing force, wherein the changeover mechanism (40) changes from the first position of the valving element (43) to the second position of the valving element (43), when the discharge pressure becomes higher than or equal to a pressure level at which the cam ring (15) can move against the set load of the biasing mechanism (33, 34), and is lower than or equal to a pressure level at which the third biasing force of the biasing mechanism (33, 34) is increased in the stepwise manner.

Accordingly, the valving element (43) moves to the second position when the discharge pressure (P) becomes higher than or equal to the pressure level at which the cam ring (15) can move. Thereby, the eccentricity of the cam ring (15) is reduced, so that the discharge pressure (P) is reduced and again becomes lower than said pressure level. Then, the valving element (43) is returned back to the first position. Such an action is repeated. Therefore, as an advantageous effect, a desired value of the discharge pressure (P) can be maintained within a preferable range while suppressing a rise of the discharge pressure (P) that is caused by the increase of engine rotation.

[b] The variable displacement oil pump as described in the item [a], wherein the second control oil chamber (e.g., 32 in the drawings) communicates with the discharge portion (22*a*, 22*c*) in the first position of the valving element (43).

[c] The variable displacement oil pump as described in the item [a], wherein the biasing mechanism (e.g., 33, 34 in the drawings) includes a plurality of biasing members acting on the cam ring (15).

[d] The variable displacement oil pump as described in the item [c], wherein the biasing mechanism (e.g., 33, 34 in the drawings) includes a first spring (33) provided to bias the cam ring (15) in the direction that enlarges the eccentricity between the rotation center of the rotor (16) and the center of the inner circumferential surface of the cam ring (15), and a second spring (34) configured to bias the cam ring (15) in the direction that reduces the eccentricity between the rotation center of the rotor (16) and the center of the inner circumferential surface of the cam ring (15), and configured to stop biasing the cam ring (15) under a compressed state of the second spring (34) when the eccentricity between the rotation center of the rotor (16) and the center of the inner circumferential surface of the cam ring (15) becomes smaller than or equal to a predetermined amount.

[e] The variable displacement oil pump as described in the item [d], wherein the second spring (e.g., 34 in the drawings) is set to have a biasing force smaller than that of the first spring (33), and is provided between opposed walls whose distance is shorter than a maximum extensional length of the second spring (34) such that the second spring (34) is made away from the cam ring (15) when the eccentricity between the rotation center of the rotor (16) and the center of the inner circumferential surface of the cam ring (15) becomes smaller than or equal to the predetermined amount.

[f] The variable displacement oil pump as described in the item [c], wherein the biasing mechanism (e.g., 33, 34 in the drawings) includes a first spring (33) provided to bias the cam ring (15) in the direction that enlarges the eccentricity between the rotation center of the rotor (16) and the center of the inner circumferential surface of the cam ring (15), and a second spring (34) configured to bias the cam ring (15) in the direction that reduces the eccentricity between the rotation center of the rotor (16) and the center of the inner circumferential surface of the cam ring (15) when the eccentricity becomes larger than or equal to a predetermined amount.

[g] The variable displacement oil pump as described in the item [a], wherein the cam ring (e.g., 15 in the drawings) is accommodated in a housing, the first control oil chamber (31) and the second control oil chamber (32) are formed between an inner circumferential surface of the housing and an outer circumferential surface of the cam ring (15), and a pressure-receiving area of the cam ring (15) which faces the first control oil chamber (31) is set to be larger than a pressure-receiving area of the cam ring (15) which faces the second control oil chamber (32).

According to such a structure, a variable control mechanism of the cam ring (15) can be easily constructed. Therefore, the pump structure can be simplified to improve a productivity and a reduction in manufacturing cost.

[h] The variable displacement oil pump as described in the item [a], wherein the valving element (e.g., 43 in the drawings) of the changeover mechanism (40) is constituted by a spool including a plurality of large-diameter portions and small-diameter portions, the spool is formed with a hollow portion open only to axially one end side of the spool, an opening end portion of the hollow portion communicates with the drain portion (57), at least one of the small-diameter portions is formed with a communication passage connecting the hollow portion with a region radially outside the one of the small-diameter portions, and the discharge pressure is applied to axially another end side of the spool.

According to such a structure, a large-diameter portion (land portion) for connecting/disconnecting each control oil chamber (31, 32) with/from the drain portion (57) can be omitted or reduced in the spool. Therefore, the spool can be shortened in its axial length. As a result, the pump can be downsized.

[i] The variable displacement oil pump as described in the item [a], wherein the spool includes a first large-diameter portion (e.g., 43*a* in the drawings) formed on a side of the hollow portion which is opposite to the opening end portion, and configured to apply the discharge pressure, a second large-diameter portion (43*b*) formed on the opening end portion of the hollow portion, a third large-diameter portion (43*c*) formed between the first large-diameter portion (43*a*) and the second large-diameter portion (43*b*), a first small-diameter portion (43*d*) formed between the third large-diameter portion (43*c*) and the first large-diameter portion (43*a*), and a second small-diameter portion (43*e*) formed between the second large-diameter portion (43*b*) and the third large-diameter portion (43*c*), wherein the communication passage is formed in the first small-diameter portion (43*d*), wherein the discharge pressure is introduced through a region radially outside the second small-diameter portion (43*e*) into the second control oil chamber (32).

[j] The variable displacement oil pump as described in the item [i], wherein the first control oil chamber (e.g., 31 in the drawings) communicates through a region radially outside the first small-diameter portion (43*d*) and the communication passage with the drain portion (57), and the discharge pressure is introduced through the region radially outside the second small-diameter portion (43*e*) into the second control oil chamber (32), when the valving element (43) is in the first position.

[k] The variable displacement oil pump as described in the item [j], wherein the discharge pressure is introduced through a region axially outside the first large-diameter portion (e.g., 43*a* in the drawings) into the first control oil chamber (31), and the discharge pressure is introduced through the region radially outside the second small-diameter portion (43*e*) into the second control oil chamber (32), when the valving element (43) is in the second position.

[l] The variable displacement oil pump as described in the item [k], wherein the discharge pressure is introduced through the region axially outside the first large-diameter portion (e.g., 43*a* in the drawings) into the first control oil chamber (31), and the region radially outside the second small-diameter portion (43*e*) is disconnected from the second control oil chamber (32) by the third large-diameter portion (43*c*), when the valving element (43) is in the third position.

[m] A variable displacement oil pump comprising: pump constituting members configured to be rotationally driven such that oil introduced from a suction portion (e.g., 21*a*, 21*c* in the drawings) is discharged from a discharge portion (22*a*, 22*c*), and configured to vary volumes of a plurality of working-oil rooms with a rotation thereof; a varying mechanism configured to vary a volume-variation rate of each of the plurality of working-oil rooms by moving a movable member (15); a biasing mechanism configured to bias the movable member (15) in a direction that increases the volume-variation rate of the working-oil room under a state where the biasing mechanism is given a set load; a first control oil chamber (31) configured to apply force to the movable member (15) in a direction against the biasing direction of the biasing mechanism, by a discharge pressure introduced from the discharge portion (22) into the first control oil chamber (31); a second control oil chamber (32) configured to apply force to the movable member (15) in the biasing direction of the biasing mechanism, by the discharge pressure introduced from the discharge portion (22) into the second control oil chamber (32); a changeover mechanism (40) configured to change over among a first position of a valving element (43) in which at least the first control oil chamber (31) communicates with a drain portion (57), a second position of the valving element (43) in which the discharge pressure is introduced into the first control oil chamber (31) and the second control oil chamber (32), and a third position of the valving element (43) in which the discharge pressure is introduced into the first control oil chamber (31) and a part of oil within the second control oil chamber (32) is drained to the drain portion (57), in accordance with an operating state of the pump constituting members; and a restricting section configured to restrict the movement of the movable member (15) when the changeover mechanism (40) is in a position except the first position and the third position, wherein the changeover mechanism (40) retains the valving element (43) in the first position when the discharge pressure is lower than a pressure level by which the restricting section (28) suppresses the movement of the movable member (15).

[n] The variable displacement oil pump as described in the item [m], wherein the changeover of the changeover mechanism (e.g., 40) is electrically controlled.

According to such a structure, a more appropriate changeover control can be achieved, so that the problem that the discharge pressure (P) is unnecessarily enlarged can be suppressed more effectively.

[o] The variable displacement oil pump as described in the item [n], wherein the changeover of the changeover mechanism (e.g., 40) is controlled according to an operating state of engine.

According to such a structure, a more appropriate discharge-pressure control can be achieved, so that the problem that the discharge pressure (P) is unnecessarily enlarged can be suppressed much more effectively.

[p] The variable displacement oil pump as described in the item [o], wherein the restricting section is configured to prevent the movement of the movable member (e.g., 15 in the drawings) when the discharge pressure is lower than or equal to a predetermined level, and configured to allow the movement of the movable member (15) when the discharge pressure is higher than the predetermined level.

This application is based on prior Japanese Patent Application No. 2011-279096 filed on Dec. 21, 2011. The entire contents of this Japanese Patent Application are hereby incorporated by reference.

The scope of the invention is defined with reference to the following claims.

What is claimed is:

1. A variable displacement oil pump comprising:

a rotor configured to be rotationally driven;

a plurality of vanes movable out from and into an outer circumferential portion of the rotor;

a cam ring separately forming a plurality of working-oil rooms by receiving the rotor and the plurality of vanes in an inner circumferential space of the cam ring, wherein the cam ring is configured to move to vary an eccentricity between a rotation center of the rotor and a center of an inner circumferential surface of the cam ring and thereby to vary a variation rate of volume of each of the plurality of working-oil rooms which is produced when the rotor rotates;

a lateral wall provided on at least one of lateral portions of the cam ring, wherein the lateral wall includes a suction portion open to the working-oil room whose volume is increasing when the rotor is rotating under a state where the cam ring is eccentric, and a discharge portion open to the working-oil room whose volume is decreasing when the rotor is rotating under the state where the cam ring is eccentric;

a first control oil chamber configured to apply a first biasing force to the cam ring in a direction that reduces the eccentricity between the rotation center of the rotor and the center of the inner circumferential surface of the cam ring, by oil discharged and introduced from the discharge portion into the first control oil chamber;

a second control oil chamber configured to apply a second biasing force to the cam ring in a direction that enlarges the eccentricity between the rotation center of the rotor and the center of the inner circumferential surface of the cam ring, by oil discharged and introduced from the discharge portion into the second control oil chamber, wherein the second biasing force is smaller than the first biasing force;

a biasing mechanism configured to apply a third biasing force to the cam ring in the direction that enlarges the eccentricity between the rotation center of the rotor and the center of the inner circumferential surface of the cam ring under a state where the biasing mechanism is given a set load, wherein the biasing mechanism is configured to increase the third biasing force discontinuously in a stepwise manner when the eccentricity between the rotation center of the rotor and the center of the inner circumferential surface of the cam ring becomes lower than or equal to a predetermined amount; and a changeover mechanism including a valving element receiving a fourth biasing force in a direction toward a first position of the valving element and configured to move against the fourth biasing force by a discharge pressure discharged from the discharge portion, configured to connect the first control oil chamber with a drain portion when the valving element is in the first position, configured to introduce the discharge pressure into the first control oil chamber and the second control oil chamber when the valving element moves and reaches a second position thereof against the fourth biasing force, and configured to drain a part of oil of the second control oil chamber to the drain portion and to continue to introduce the discharge pressure into the first control oil chamber when the valving element moves from the second position and reaches a third position thereof against the fourth biasing force, wherein the changeover mechanism changes from the first position of the valving element to the second position of the valving element, when the discharge pressure becomes higher than or equal to a pressure level at which the cam ring can move against the set load of the biasing mechanism, and is lower than or equal to a pressure level at which the third biasing force of the biasing mechanism is increased in the stepwise manner.

2. The variable displacement oil pump according to claim 1, wherein the second control oil chamber communicates with the discharge portion in the first position of the valving element.

3. The variable displacement oil pump according to claim 1, wherein the biasing mechanism includes a plurality of biasing members acting on the cam ring.

4. The variable displacement oil pump according to claim 3, wherein the biasing mechanism includes a first spring provided to bias the cam ring in the direction that enlarges the eccentricity between the rotation center of the rotor and the center of the inner circumferential surface of the cam ring, and a second spring configured to bias the cam ring in the direction that reduces the eccentricity between the rotation center of the rotor and the center of the inner circumferential surface of the cam ring, and configured to stop biasing the cam ring under a compressed state of the second spring when the eccentricity between the rotation center of the rotor and the center of the inner circumferential surface of the cam ring becomes smaller than or equal to a predetermined amount.

5. The variable displacement oil pump according to claim 4, wherein the second spring is set to have a biasing force smaller than that of the first spring, and is provided between opposed walls whose distance is shorter than a maximum extensional length of the second spring such that the second spring is made away from the cam ring when the eccentricity between the rotation center of the rotor and the center of the inner circumferential surface of the cam ring becomes smaller than or equal to the predetermined amount.

6. The variable displacement oil pump according to claim 3, wherein the biasing mechanism includes a first spring provided to bias the cam ring in the direction that enlarges the eccentricity between the rotation center of the rotor and the center of the inner circumferential surface of the cam ring, and a second spring configured to bias the cam ring in the direction that reduces the eccentricity between the rotation center of the rotor and the center of the inner circumferential surface of the cam ring when the eccentricity becomes larger than or equal to a predetermined amount.

7. The variable displacement oil pump according to claim 1, wherein the cam ring is accommodated in a housing, the first control oil chamber and the second control oil chamber are formed between an inner circumferential surface of the housing and an outer circumferential surface of the cam ring, and a pressure-receiving area of the cam ring which faces the first control oil chamber is set to be larger than a pressure-receiving area of the cam ring which faces the second control oil chamber.

8. The variable displacement oil pump according to claim 1, wherein the valving element of the changeover mechanism is constituted by a spool including a plurality of large-diameter portions and small-diameter portions, the spool is formed with a hollow portion open only to axially one end side of the spool, an opening end portion of the hollow portion communicates with the drain portion, at least one of the small-diameter portions is formed with a communication passage connecting the hollow portion with a region radially outside the one of the small-diameter portions, and the discharge pressure is applied to axially another end side of the spool.

9. The variable displacement oil pump according to claim 8, wherein the spool includes a first large-diameter portion formed on a side of the hollow portion which is opposite to the opening end portion, and configured to apply the discharge pressure, a second large-diameter portion formed on the opening end portion of the hollow portion, a third large-diameter portion formed between the first large-diameter portion and the second large-diameter portion, a first small-diameter portion formed between the third large-diameter portion and the first large-diameter portion, and a second small-diameter portion formed between the second large-diameter portion and the third large-diameter portion, wherein the communication passage is formed in the first small-diameter portion, wherein the discharge pressure is introduced through a region radially outside the second small-diameter portion into the second control oil chamber.

10. The variable displacement oil pump according to claim 9, wherein the first control oil chamber communicates through a region radially outside the first small-diameter portion and the communication passage with the drain portion, and the discharge pressure is introduced through the region radially outside the second small-diameter portion into the second control oil chamber, when the valving element is in the first position.

11. The variable displacement oil pump according to claim 10, wherein the discharge pressure is introduced through a region axially outside the first large-diameter portion into the first control oil chamber, and the discharge pressure is introduced through the region radially outside the second small-diameter portion into the second control oil chamber, when the valving element is in the second position.

12. The variable displacement oil pump according to claim 11, wherein the discharge pressure is introduced through the region axially outside the first large-diameter portion into the first control oil chamber, and the region radially outside the second small-diameter portion is disconnected from the second control oil chamber by the third large-diameter portion, when the valving element is in the third position.

13. A variable displacement oil pump comprising:

pump constituting members configured to be rotationally driven such that oil introduced from a suction portion is discharged from a discharge portion, and configured to vary volumes of a plurality of working-oil rooms with a rotation thereof;

a varying mechanism configured to vary a volume-variation rate of each of the plurality of working-oil rooms by moving a movable member;

a biasing mechanism configured to bias the movable member in a direction that increases the volume-variation rate of the working-oil room under a state where the biasing mechanism is given a set load;

a first control oil chamber configured to apply force to the movable member in a direction against the biasing direction of the biasing mechanism, by a discharge pressure introduced from the discharge portion into the first control oil chamber;

a second control oil chamber configured to apply force to the movable member in the biasing direction of the biasing mechanism, by the discharge pressure introduced from the discharge portion into the second control oil chamber;

a changeover mechanism configured to change over among a first position of a valving element in which at least the first control oil chamber communicates with a drain portion, a second position of the valving element in which the discharge pressure is introduced into the first control oil chamber and the second control oil chamber, and a third position of the valving element in which the discharge pressure is introduced into the first control oil chamber and a part of oil within the second control oil chamber is drained to the drain portion, in accordance with an operating state of the pump constituting members; and a restricting section configured to restrict the movement of the movable member when the changeover mechanism is in a position except the first position and the third position, wherein the changeover mechanism retains the valving element in the first position when the discharge pressure is lower than a pressure level by which the restricting section suppresses the movement of the movable member.

14. The variable displacement oil pump according to claim 13, wherein the changeover of the changeover mechanism is electrically controlled.

15. The variable displacement oil pump according to claim 14, wherein the changeover of the changeover mechanism is controlled according to an operating state of engine.

16. The variable displacement oil pump according to claim 15, wherein the restricting section is configured to prevent the movement of the movable member when the discharge pressure is lower than or equal to a predetermined level, and configured to allow the movement of the movable member when the discharge pressure is higher than the predetermined level.

* * * * *